United States Patent [19]

Mahabir

[11] 4,153,093

[45] May 8, 1979

[54] BILLFOLD AND SMALL ITEM HOLDER

[75] Inventor: Vanda J. Mahabir, Ottawa, Canada

[73] Assignee: Raymond Lee Organization, Inc., New York, N.Y.

[21] Appl. No.: 696,319

[22] Filed: Jun. 15, 1976

[51] Int. Cl.[2] ..... A45C 1/06

[52] U.S. Cl. ..... 150/35

[58] Field of Search ..... 150/1.6, 34, 35, 38, 150/39

[56] References Cited

U.S. PATENT DOCUMENTS

| | | | |
|---|---|---|---|
| 2,203,830 | 6/1940 | Leve | 150/35 |
| 2,383,108 | 8/1945 | Cibert | 150/38 |
| 2,520,176 | 8/1950 | Stanley | 150/38 X |
| 2,803,281 | 8/1957 | Sutton | 150/35 |

*Primary Examiner*—Donald F. Norton

*Attorney, Agent, or Firm*—Stephen Wyden

[57] ABSTRACT

A zipper closable billfold having inside it a zippered money compartment, several open compartments, a loop for a comb and a ring for keys, on the outside of the billfold a ticket pocket and a change pocket mounted thereon are surrounded by a large zippered pocket and on the other side of the outside another large zippered pocket can hold bulky items such as rulers.

2 Claims, 3 Drawing Figures

BILLFOLD AND SMALL ITEM HOLDER

I have invented a new and improved billfold and small item holder. My billfold and small item holder provides convenience for the carrying of a variety of items and is in a shape convenient for use by both men and women. Because of its compact size and organization it may be of value for many people in their daily lives.

My invention can be understood in view of the accompanying figures.

Figure 1:
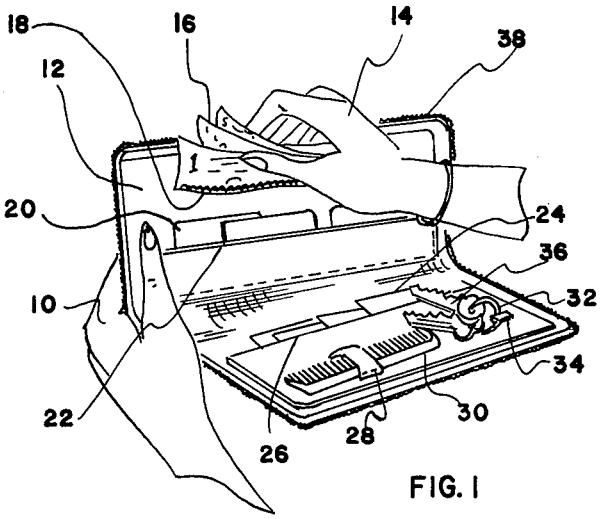
FIG. 1 shows a person using the billfold in the open position.
Figure 2:
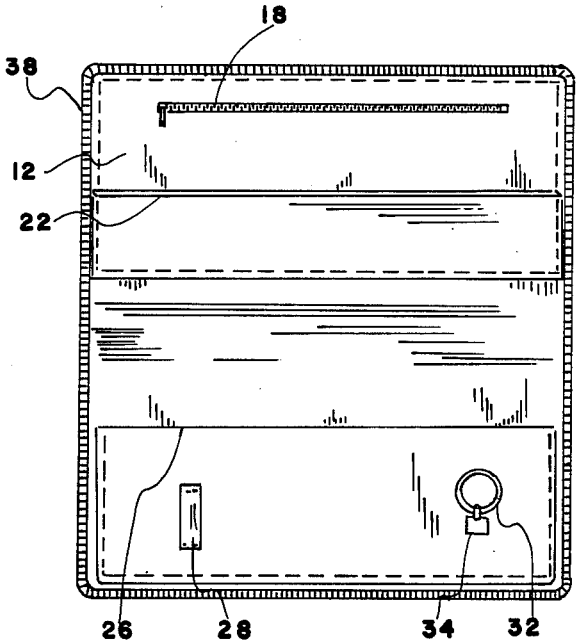
FIG. 2 is a front view of the opened billfold and small item holder.

With regard to FIGS. 1 and 2, a person can use one hand 10 to hold the billfold and small item holder 12 while removing with the other hand 14 money 16 from a zippered money compartment 18. A plurality of credit cards 20 can be removed from a long narrow pocket 22 attached to the front of the money compartment 18. Other cards and important papers 24 can be seen held in a long narrow pocket 26 in the lower part of the billfold and small item holder 12. A loop 28 attached to the front of the lower pocket 26 can hold a comb 30. A split ring 32 attached by an attachment 34 to the front of the lower pocket 26 holds a plurality of keys 36, ready for use. When the billfold and small item holder 12 is folded downward the zipper 38 can be closed securing the credit cards and other small items in the various compartments of the holder 12.

Figure 3:
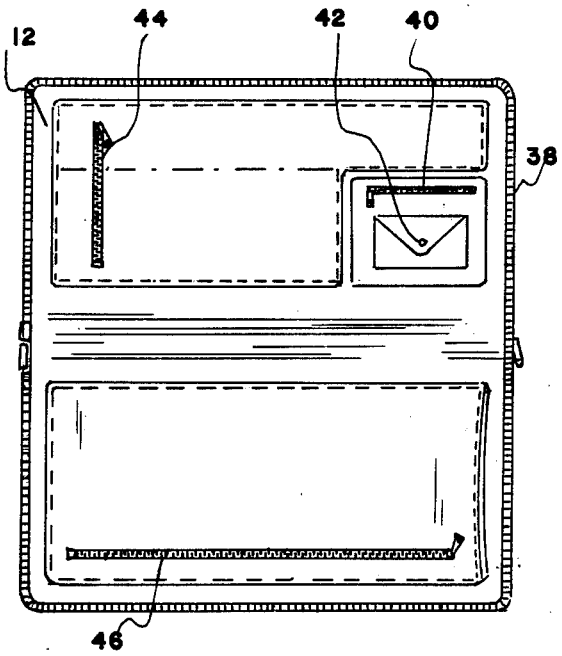
FIG. 3 is a view of the outside of the billfold and small item holder.

With regard to FIG. 3, the outside of the billfold 12 has along the upper portion a vertically zippered compartment 44 for holding pencils, pens and other similar items. A small corner of the upper outside surface carries a zippered pocket 40 for tickets. On the face of the ticket pocket 40 an envelope shaped snap closeable change pocket 42 is attached. Along the lower outside surface of the billfold 12 a large laterally zippered pocket 46 is mounted for carrying rulers and other large bulky items. The zipper 38 for closing the billfold is seen around the edge of the outside of the billfold and small item holder 12.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. An improved billfold and small item holder, comprising:
   - a foldable billfold,
   - a zipper attached around an edge of the billfold, whereby the billfold may be closed,
   - a zippered money compartment attached to an upper inside surface of the billfold,
   - a pocket extending across a lower portion of a front of the money compartment attached to the front of the money compartment,
   - a pocket attached to a lower portion of the inside of the billfold,
   - a loop attached to a front of the lower pocket, whereby a comb may be removably secured to the billfold, and
   - a key ring secured to the front of the lower pocket.

2. The improved billfold and small item holder of claim 1, further comprising:
   - a large laterally zippered pocket attached to a lower outside surface of the billfold, whereby bulky items such as a ruler may be stored,
   - a zippered ticket pocket attached to a lower edge of an upper part of the outside of the billfold,
   - an envelope shaped snappably closable change pocket attached to an outside surface of the ticket pocket, and
   - a vertically zippered pocket attached to the upper portion of the outside surface of the billfold.

* * * * *